US010533585B2

(12) United States Patent
Landberg

(10) Patent No.: US 10,533,585 B2
(45) Date of Patent: Jan. 14, 2020

(54) TELESCOPIC DEVICE AND METHOD FOR OPERATING A TELESCOPIC DEVICE

(71) Applicant: SAAB AB, Linköping (SE)

(72) Inventor: Magnus Landberg, Linköping (SE)

(73) Assignee: SAAB AB, Linköping (DE)

( * ) Notice: Subject to any disclaimer, the term of this patent is extended or adjusted under 35 U.S.C. 154(b) by 0 days.

(21) Appl. No.: 15/775,941

(22) PCT Filed: Nov. 16, 2015

(86) PCT No.: PCT/SE2015/051228

§ 371 (c)(1),
(2) Date: May 14, 2018

(87) PCT Pub. No.: WO2017/086844

PCT Pub. Date: May 26, 2017

(65) Prior Publication Data

US 2018/0328387 A1 Nov. 15, 2018

(51) Int. Cl.
*F15B 15/16* (2006.01)
*B66C 23/70* (2006.01)
(Continued)

(52) U.S. Cl.
CPC ..... *F15B 15/16* (2013.01); *B66C 23/705* (2013.01); *B66C 23/708* (2013.01); *E21B 7/025* (2013.01);
(Continued)

(58) Field of Classification Search
CPC ..... F15B 15/16; F15B 15/165; F15B 15/262; F15B 15/268
See application file for complete search history.

(56) References Cited

U.S. PATENT DOCUMENTS 3,804,262 A 4/1974 Wiencek et al.
3,831,901 A * 8/1974 Williams ..... F15B 15/16 92/15
(Continued)

FOREIGN PATENT DOCUMENTS

DE 2649958 A1 5/1978
GB 1360141 A 7/1974

OTHER PUBLICATIONS

International Search Report with Written Opinion dated Jul. 15, 2016 issued in corresponding international application No. PCT/SE2015/051228 (12 pages).
(Continued)

*Primary Examiner* — Michael Leslie
(74) *Attorney, Agent, or Firm* — Venable LLP; Jeffri A. Kaminski

(57) ABSTRACT

A method for operating a telescopic device and the elongated telescopic device per se comprises a support element formed to encompass first and second telescopic element mounted so as to be telescopically slidable relative each other in a longitudinal direction; the support element comprises a support element fluid actuator assembly; the first telescopic element is arranged to encompass the second telescopic element and comprises a first fluid actuator assembly. The support element fluid actuator assembly is fixed to an interior portion of the support element and is arranged for engagement or disengagement to a first envelope surface of the first telescopic element and wherein the first fluid actuator assembly is fixed to a first interior portion of the first telescopic element and is arranged for engagement or disengagement to a second envelope surface of the second telescopic element.

11 Claims, 5 Drawing Sheets

(51) Int. Cl.

| | |
|---|---|
| ***E21B 7/02*** | (2006.01) |
| ***F15B 11/18*** | (2006.01) |
| ***F15B 15/14*** | (2006.01) |
| *F15B 15/26* | (2006.01) |

(52) U.S. Cl.
CPC ..... *F15B 11/183* (2013.01); *F15B 15/148* (2013.01); *F15B 15/262* (2013.01)

(56) References Cited

U.S. PATENT DOCUMENTS

| | | | | |
|---|---|---|---|---|
| 4,526,086 | A | 7/1985 | Holton et al. | |
| 5,111,733 | A * | 5/1992 | Baraniak | F15B 15/165 91/167 R |
| 5,513,554 | A * | 5/1996 | Paulsson | F15B 15/16 92/18 |
| 5,628,416 | A | 5/1997 | Frommelt et al. | |
| 5,632,395 | A | 5/1997 | Zimmermann | |
| 6,527,131 | B1 | 3/2003 | Brockelmann et al. | |

OTHER PUBLICATIONS

International Preliminary Report on Patentability dated Mar. 5, 2018 issued in corresponding international application No. PCT/SE2015/051228 (15 pages).

* cited by examiner

1

TELESCOPIC DEVICE AND METHOD FOR OPERATING A TELESCOPIC DEVICE

CROSS-REFERENCES TO RELATED APPLICATIONS

This application is a U.S. National Stage application of PCT/SE2015/051228, filed Nov. 16, 2015 and published on May 26, 2017 as WO/2017/086844, the contents of which is hereby incorporated by reference in its entirety.

TECHNICAL FIELD

The present invention relates to an elongated telescopic device according to the preamble of claim 1. The present invention also relates to a method for operating the telescopic device. The present invention may concern the industry using hydraulic and/or pneumatic actuators for different types of applications and may also concern the manufacture industry producing telescopic devices.

The invention may relate to elongated telescopic devices comprising single acting and/or double acting fluid actuator assemblies.

The present invention may be put into use in mobile cranes or mobile drilling apparatus vehicles.

BACKGROUND ART

Current fluid actuator assemblies used in telescopic devices are bulky and heavy. There are several telescopic devices designed trying to solve such problems. Prior art telescopic devices are also slow and labour intensive to extend.

U.S. Pat. No. 3,804,262 shows a telescopic device of a mobile crane having telescopic hollow boom sections, in which there are arranged a respective hydraulic actuator for propulsion of the boom sections for extension and retraction.

U.S. Pat. No. 5,628,416 shows a telescopic device of a mobile crane having telescopic boom members and a single stage piston and cylinder unit and locking bolts for coupling each boom member to the actuator unit for extension and retraction.

U.S. Pat. No. 5,632,395 shows a telescopic device of a mobile telescopic crane having a multistage simple-acting piston-cylinder unit arranged for extending the telescopic crane. A steel rope is provided for retracting the telescopic crane.

SUMMARY OF THE INVENTION

There is an object to provide a compact and lightweight elongated telescopic device of the type defined in the introduction.

There is also an object to provide a compact and lightweight elongated telescopic device that can be extended and retracted in an energy efficient way.

There is an object to reach more efficient control of speed and force of an elongated telescopic device.

Yet another object is to reduce power output of associated fluid supply device of an elongated telescopic device.

There is also an object to reduce energy losses.

An object is to improve current elongated telescopic devices in mobile and industrial applications.

An object is to provide an elongated telescopic device to accomplish work with only a small amount of input force.

An object is to provide an elongated telescopic device that is energy-efficient and fast to extend.

A further object is to provide an elongated telescopic device, which can be used in smart fluid power component systems including self-diagnostics and plug-and-play (easy to use) functionality.

A further object is to provide an elongated telescopic device, which can be used in modular systems comprising standardized fluid actuator assembly units having standardized piston bodies.

This or at least one of said objects has been achieved by an elongated telescopic device comprising a support element formed to partly or entirely encompass (nestled) first and second telescopic element mounted so as to be telescopically slidable relative each other in an longitudinal direction; the support element comprises a support element fluid actuator assembly; the first telescopic element is arranged to encompass the second telescopic element and comprises a first fluid actuator assembly; characterized in that the support element fluid actuator assembly is fixed to an interior portion of the support element and is arranged for engagement or disengagement to a first envelope surface of the first telescopic element; and in that the first fluid actuator assembly is fixed to a first interior portion of the first telescopic element and is arranged for engagement or disengagement to a second envelope surface of the second telescopic element.

Thereby is achieved that the elongated telescopic device can be made lightweight and compact since the encompassed telescopic element (hollow boom) is used as a piston rod moved by the fluid actuator assembly simultaneously as it is used as a telescopic element. Thereby is provided that the elongated telescopic device operates in an energy efficient way.

The piston rod engagement and disengagement device

Preferably, a second fluid actuator assembly is fixed to a second interior portion of the second telescoping element and is arranged for engagement or disengagement to a third envelope surface of a third telescoping element.

Thereby is achieved that the third telescoping element can moved into or out from the second telescoping element. Preferably, the inner portion of the telescoping element (first, second, third) may be an inner wall of the telescoping element.

Suitably, the elongated telescopic device comprises a plurality of telescoping elements mounted so as to be telescopically slidable relative each other, each telescoping element comprises a fluid actuator assembly arranged for engagement with (clamping to) an adjacent telescoping element.

Thereby is provided a relatively long telescopic device that can be used as a crane boom or other arm member.

Preferably, a bearing member is arranged between two adjacent telescoping elements, which bearing member comprises bronze alloy and/or tin bronze and/or lead free bronze and/or copper and/or aluminium-bronze and/or carbon graphite.

Thereby is achieved that the telescoping elements slides with decreased friction.

Suitably, the telescoping element exhibits a circular cross-section.

Thereby is achieved that the respective telescoping element can be used as a boom or arm member per se, wherein the respective telescoping element features a hollow piston rod section.

Preferably, at least one fluid actuator assembly comprises a first cylinder chamber and a first piston body having a first expandable hollow space provided for fluid communication with the first cylinder chamber so as to provide (a clamping action) engagement with an envelope surface of an inside positioned telescopic element.

Preferably, the first piston body is slidably arranged in a cylinder housing and divides the cylinder housing into a first cylinder chamber and a second cylinder chamber.

Suitably, first chamber is pressurized with a first pressure, whereby the first piston body will be in engagement with the envelope surface of the adjacent positioned telescopic element.

Preferably, the first pressure is transferred directly to the first expandable hollow space so as to expand a first expandable clamping wall of the first piston body.

Suitably, a first engagement and disengagement device of the first piston body comprises the first expandable hollow space and the first expandable clamping wall.

Preferably, the first pressure is transferred from the first cylinder chamber to the first expandable hollow space via a channel system of the first piston body.

Suitably, the channel system comprises an opening facing the first cylinder chamber and comprises a further opening entering the first expandable hollow space.

The first engagement and disengagement device of the first piston body is thus directly controlled by the first pressure of the pressurized first cylinder chamber, wherein said first pressure also acts on the first expandable clamping wall for expansion toward the envelope surface of the adjacent telescopic element for providing said clamping action.

Suitably, the first expandable clamping wall expands in radial direction toward the envelope surface of the adjacent positioned telescopic element and clamps around said envelope surface.

Preferably, the first engagement and disengagement device is rigidly fixed to the first piston body.

The first pressure of the pressurized first cylinder chamber acts on the first piston body, for moving the first piston body in axial direction together with the adjacent telescopic element, as the first piston body clamps on the envelope surface of the adjacent telescopic element when the first expandable hollow space also is pressurized.

The first engagement and disengagement device will thus upon pressurizing of the first chamber be engaged with the adjacent telescopic element by means of the first pressure pressing the expandable clamping wall (membrane) in radial direction towards the envelope surface of the adjacent telescopic element.

There is thus achieved that engagement between the envelope surface of the adjacent telescopic element and the first piston body is performed directly and promptly without any additional mechanical parts.

Thereby is provided that the engagement and disengagement device can be controlled by the same control device (control valve device and control unit), which control device also controls the movement of the first piston body relative the cylinder housing by pressurization of the respective cylinder chamber.

Preferably, the first fluid actuator assembly comprises said first piston body, said first cylinder housing, said first engagement and disengagement device and second fluid actuator assembly comprising a second piston body, a second cylinder housing, a second engagement and disengagement device.

Suitably, the second piston body thus comprises the second engagement and disengagement device adapted to be able to engage or disengage the second piston body to/from the envelope surface of said adjacent telescopic element in a similar way as described for the first piston body.

The first and second piston body of the first fluid actuator assembly acts alternately for propelling the adjacent telescopic element.

Preferably, the (first, second etc.) hollow space is entirely sealed and provided in a sealed manner within the (first, second etc.) piston body, so that no fluid is permitted to leak to the contact surface of the piton body and the envelope surface of the encompassed telescopic element.

Thereby is achieved an optimal and reliable functionality providing accurate performance of the fluid actuator arrangement.

Thereby is provided a compact and low-weight (and energy saving) fluid actuator arrangement that can propel the adjacent telescopic element a major distance and back again, wherein the respective first and second piston body in turn is engaged with the adjacent telescopic element.

Thereby is achieved a membrane that can be used as a coupling device between the piston rod and the piston device.

Preferably, the proportion between the measure of inner and outer circumference of the piston body envelope surface (inner circumference/outer circumference) is larger than 0.5.

Thereby (the circumference of the engagement and disengagement device is relatively large in view of the piston force area) is achieved that the clamping surface can be made relatively short seen in the longitudinal direction still providing rigid engagement and thus the length of the piston body. This saves weight and space.

Suitably, the inner circumference measure of the piston body and the length measure (seen in the longitudinal direction) of the piston body define an area of a clamping surface of the piston body.

Preferably, the inner circumference measure of the piston body and the length measure (seen in the longitudinal direction) of the piston body define an area that is less than the area of a clamping surface of the piston body.

The definition of the measure of the inner circumference of the piston body envelope (inner) surface is the circumference of an imaginary circle, which has a diameter that corresponds with an inner diameter of the piston body (of a first and/or of a second and/or of a third piston body).

The definition of the measure of the outer circumference of the piston body envelope (outer) surface is the circumference of an imaginary circle, which has a diameter that corresponds with an outer diameter of the piston body (of a first and/or of a second and/or of a third piston body).

The hollow space preferably forms an expandable wall of the piston body, which expandable wall expands radially inward or outward when the hollow space is pressurized with a predetermined pressure.

The clamping surface of the piston body is thus arranged for clamping on the envelope surface of the adjacent telescoping element when the hollow space is pressurized with a predetermined pressure.

The hollow space and expandable wall (so called membrane) thus form the area of the clamping surface of the piston body. As the membrane of the piston body exhibits a large circumference (e.g.) diameter in view of the outer circumference of the piston body, the area of the clamping surface also will be relative large still if the length of the piston body is relative short in axial direction.

Thereby is achieved that the clamping area (contact area) and the transmissible axial force can be great even if the longitudinal length of the piston body is short.

Thereby is achieved that the cylinder housing is compact.

Thereby is achieved a lightweight and compact fluid actuator assembly which promotes the design of the telescoping element presenting low weight and compact feature.

Thereby is achieved an elongated telescopic device that suitably is used as a crane apparatus. The lightweight design is desired further out toward the crane tip.

Preferably, the fluid actuator assembly further comprises a second cylinder chamber, at least one of the first and second cylinder chamber is coupled to a fluid supply via a valve device.

Thereby there is achieved that a retraction of the piston body can be made by means of the fluid supply.

Suitably, the first fluid actuator assembly comprises a static clamping unit and/or at least one fluid actuator unit.

Preferably, the static clamping unit comprises a sleeve portion including a cavity (or at least two cavities), which cavity is coupled to a separate fluid supply or to a fluid supply coupled to the first and second cylinder chambers.

Suitably, the static clamping unit is activated by means of a control valve coupled to the fluid supply.

Preferably, the sleeve portion comprises an inner surface for contact with the outer envelope surface of the telescopic element and the cavity is arranged in the sleeve portion co-axially with the inner surface of the sleeve portion.

Suitably, the cavity forms a membrane comprising a flexible wall section formed between the cavity and the inner surface of the sleeve portion.

By the pressurizing of the cavity, there is achieved a stationary clamping force of the static clamping unit, which stationary clamping force holds the encompassed telescopic element in a braking state.

Suitably, the sleeve portion is provided with a standardized coupling entrance for enabling fluid communication between the fluid supply and the cavity of the sleeve portion.

Preferably, the cavity is formed by an inner sleeve and an outer sleeve.

Thereby is achieved a fluid actuator assembly comprising a static clamping unit for providing a static clamping with high force, whereby the fluid actuator assembly can be made in cost-effective production.

Suitably, the static clamping unit is activated by means of pressurized fluid fed by the fluid supply.

Preferably, the static clamping unit is activated by a separate fluid supply.

The telescoping elements can thus be rigidly positioned in extended state.

Preferably, the first fluid actuator assembly comprises the first and second piston bodies and a static clamping unit.

According to one aspect the elongated telescopic device is arranged as an arm member of a mobile drilling apparatus vehicle, which arm member carries a drilling and/or bolting equipment.

Thereby is achieved that the drilling apparatus vehicle can be designed less bulky, which is desirable in confined spaces.

According to a further aspect the elongated telescopic elements of the elongated telescopic device constitute crane boom sections or are arranged either inside or outside the crane boom sections.

Thereby is achieved that the telescopic elements can be used for providing the extraction/retraction of the crane boom sections as well as for constituting the crane boom per se.

Thereby is also achieved a less bulky mobile crane than prior art.

This is also achieved by a method for operating a telescopic device according to claim 11.

Thereby is achieved that the telescopic elements per se can be used as e.g. crane boom sections and that no additional actuators have to be mounted. Thereby is provided a telescopic device that is compact and energy saving.

Preferably, the first engagement and disengagement device comprises a clamping sleeve arranged for static clamping action around an envelope surface of an adjacent telescopic element.

Suitably, the adjacent (nestled) second telescopic element being slidable arranged in the enclosing first telescoping element, wherein the envelope surface of the second telescopic element is engaged or disengaged by the first fluid actuator assembly of the first telescoping element, is thus to be regarded to be used as a piston rod.

Preferably, a second bearing member (as a part of or as being comprised of the entire flexible clamping wall of the piston body or as a part of the entire surface of the fluid actuator assembly being in contact with the envelope surface of an adjacent telescopic element or as a portion thereof) is arranged between the fluid actuator assembly and the envelope surface of an adjacent telescoping element. The second bearing member comprises for example bronze alloy and/or tin bronze and/or lead free bronze and/or copper and/or aluminium-bronze and/or carbon graphite.

Suitably, a third bearing member is provided to the static clamping unit.

Preferably, the third bearing member comprises for example bronze alloy and/or tin bronze and/or lead free bronze and/or copper and/or aluminium-bronze and/or carbon graphite.

Suitably, the first engagement and disengagement device comprises a piston body arranged in a cylinder housing, wherein the piston body is designed for clamping action around an envelope surface of an adjacent telescopic element when any of the cylinder chambers of the cylinder housing being pressurized.

Preferably, the first pressure provided for the clamping action (engagement) being higher than the second pressure for the release (disengagement).

Suitably, the pressurizing of the first engagement and disengagement device with a second pressure for a release action involves that the first clamping sleeve or first piston body will release the clamping of the first engagement and disengagement device from the envelope surface of the adjacent (nestled) telescoping element.

Suitably, the pressurizing of the second engagement and disengagement device with a second pressure for a release action involves that the second clamping sleeve or second piston body will release the clamping of the second engagement and disengagement device from the envelope surface of the adjacent (nestled) telescoping element.

Preferably, the retraction of the first and second engagement and disengagement device (piston body) to a start position is performed by pressurizing the first engagement and disengagement device with a second pressure for release so that the piston body can be retracted in the cylinder housing to a start position.

Suitably, the pressurizing the engagement and disengagement device with a first pressure for clamping action and propelling the second engagement and disengagement device so as to provide said motion in said longitudinal direction.

Preferably, the fluid actuator assembly comprises a first engagement and disengagement device comprising a first piston body and comprises a second engagement and disengagement device comprising a second piston body.

Suitably, the piston rod engagement means comprises a pressure strengthening device, which is provided to strengthening the engagement of the first piston device to the piston rod arrangement.

Suitably, the fluid actuator assembly further comprises a third engagement and disengagement device comprising a clamping sleeve.

Preferably, the method further comprises the step of pressurizing the first and second engagement and disengagement device of the respective support element and the first telescopic element with a second pressure for release action of the first and second engagement and disengagement devices from the respective support element and the first telescopic element, so as to extend the telescopic device by means of kinetic energy.

Thereby is achieved an energy efficient operation of the telescopic device, by that the moved mass of the telescopic device is used for additional propulsion for extending the telescopic device.

There is thus provided a fast extension of the telescopic device as the engagement and disengagement device (actuators) are released and the propulsion is achieved by means of the kinetic energy and alternatively also by means of gravity.

Suitably, the method further comprises the step of lowering the telescopic device to a negative slope so as to make use of potential energy to extend the encompassed first and second telescopic element.

Thereby is provided an even more energy efficient operation of the telescopic device.

Suitably, the elongated telescopic device comprises fluid actuator assemblies using two or more cooperating fluid actuator units fixed to an interior portion of an outer telescoping element at the outer end thereof and coupled for engagement and disengagement to an outer portion of an inner telescoping element housed within and in contact with the outer telescoping element.

Preferably, the elongated telescopic device comprises at least one fluid actuator assembly using at least one fluid brake clamping unit for static holding and at least one fluid actuator unit fixed to an interior portion of an outer telescoping element at the outer end thereof and coupled for engagement and disengagement to an outer portion of an inner telescoping element housed within and in contact with the outer telescoping element.

Suitably, the piston rod engagement and disengagement device comprises a pressure strengthening device, which is provided to strengthening the engagement of the first piston device to the adjacent telescopic element outer envelope surface.

Preferably, each standardized piston body comprises an expandable hollow space provided for fluid communication with a cylinder chamber of a standardized cylinder housing enclosing the standardized piston body.

Suitably, by pressurization of the hollow space to a certain degree there is provided a clamping action of the standardized piston body to an envelope surface of an inside positioned telescoping element at the same time as the standardized piston body is propelled within the standardized cylinder housing by means of the pressurized cylinder chamber (being in fluid communication with the hollow space thus also being pressurized) which implies that the inside positioned telescoping element will be propelled relative the standardized cylinder housing fixed to the interior of an outer telescoping element enclosing the inside positioned telescoping element.

Preferably, the elongated telescopic device comprises a support element formed to partly or entirely encompass (nestled) first and second telescopic element mounted so as to be telescopically slidable relative each other in a longitudinal direction; the support element comprises a support element fluid actuator assembly; the first telescopic element is arranged to encompass the second telescopic element and comprises a first fluid actuator assembly; the support element fluid actuator assembly is fixed to an interior portion of the support element and is arranged for engagement or disengagement to a first envelope surface of the first telescopic element; or the support element fluid actuator assembly is fixed to a first outer portion of the first telescopic element and is arranged for engagement or disengagement to an interior surface of the support element, the first fluid actuator assembly is fixed to a first interior portion of the first telescopic element and is arranged for engagement or disengagement to a second envelope surface of the second telescopic element; or the first fluid actuator assembly is fixed to a second outer portion of the second telescopic element and is arranged for engagement or disengagement to a first interior surface of the first telescopic element.

BRIEF DESCRIPTION OF THE DRAWINGS

The present invention will now be described by way of examples with references to the accompanying schematic drawings, of which.

DETAILED DESCRIPTION

Hereinafter, embodiments of the present invention will be described with reference to the accompanying drawings, wherein for the sake of clarity and understanding of the invention some details of no importance may be deleted from the drawings.

Figure 1A:
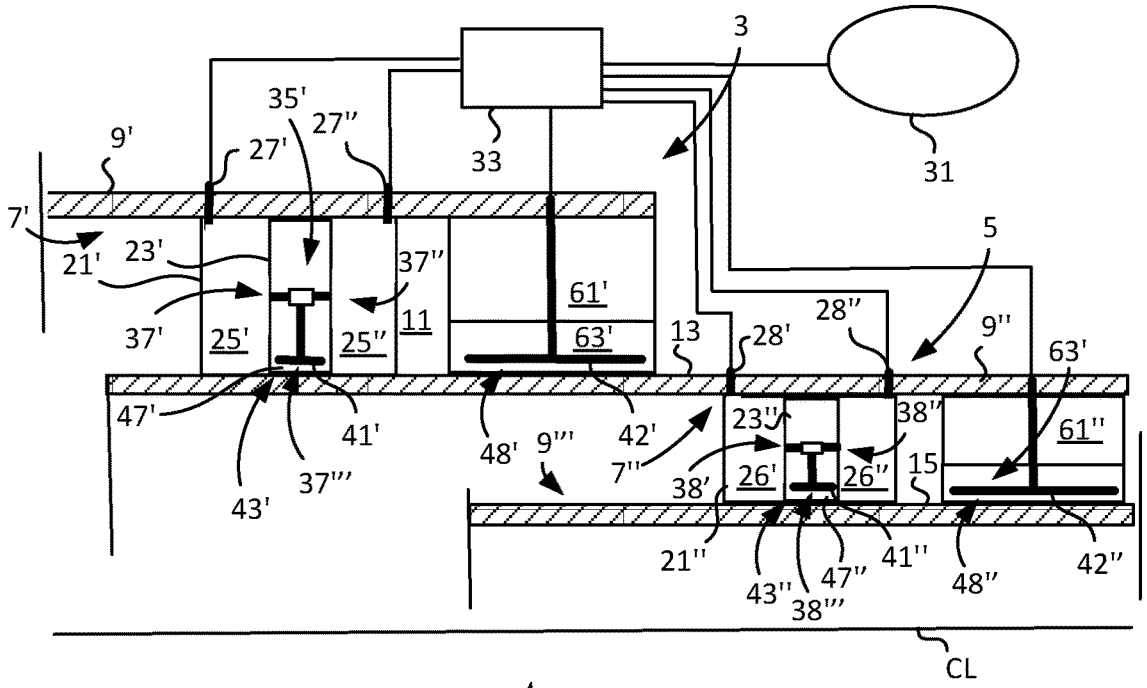
FIG. 1*a* illustrates a section of a fluid actuator assembly of a first example of a telescopic device.
Figure 1B:
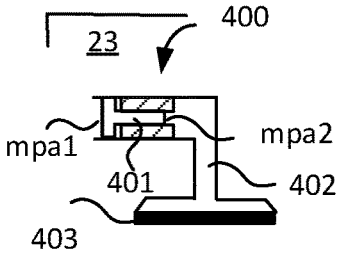
FIG. 1*b* illustrates a pressure enforcing device of a piston body.

FIG. 1*a* shows a partial cross-sectional view of a first and second fluid actuator assembly 3, 5 of a first example of a telescopic device 1. The cross-section is taken along a centre line CL of the telescopic device 1 showing only ½ of the cross-section of the first and second fluid actuator assemblies 3, 5 for convenience. The first fluid actuator assembly 3 is fixed to a first interior portion 7' (inner wall) of a first telescopic element 9' and is arranged at an outermost end 11 of the first telescopic element 9'. The first fluid actuator assembly 3 is provided for engagement or disengagement to a first envelope surface 13 of a second telescopic element 9". The second fluid actuator assembly 5 is fixed to a second interior portion 7" (inner wall) of the second telescopic element 9" and is arranged at the outermost end of the second telescopic element 9". The second fluid actuator assembly 5 is provided for engagement or disengagement to a second envelope surface 15 of a third telescopic element 9". The first fluid actuator assembly 3 comprises a first cylinder housing 21' having a first piston 23' slidable mounted therein. The first piston 23' divides an interior of the first cylinder housing 21' into a first cylinder chamber 25' having a first fluid port 27' and a second cylinder chamber 25" having a second fluid port 27". The respective first 27' and second 27" fluid port is coupled to a fluid supply 31 via a valve device 33 for controlling the movement of the first piston 23'. The first piston 23' comprises a first channel system 35' having a first cylinder chamber entrance 37' and a second cylinder chamber entrance 37" and a hollow space entrance 37". The hollow space entrance 37" is open toward a first hollow space 41' of the first piston 23', which first hollow space 41' is arranged in the first piston 23' near a first contact surface 43' of the first piston 23' contacting the first envelope surface 13 of the second telescopic element 9". The first hollow space 41' is entirely sealed and provided in a sealed manner within the first piston 23', so that no fluid is permitted to leak to the first contact surface 43' and the first envelope surface 13. The first hollow space 41' may be formed of a first and a second wall section surface 50', 50" as shown in for example FIG. 12*b*. The first wall section surface 50' of the first hollow space 41' and the first contact surface 43' are opposite each other and form a first homogeneous flexible wall portion 47' of the first piston 23', which homogeneous flexible wall portion 47' is provided to the first piston 23' as an integral portion. The first hollow space 41' is provided to be expandable by that the first homogeneous flexible portion 41' is flexible. The first hollow space 41' is provided for fluid communication with the first and second cylinder chamber 25', 25" via the first channel system 35' so as to provide a clamping action of the homogeneous flexible wall portion 47' to the first envelope surface 13 of the second telescopic element 9". The first fluid actuator assembly 3 further comprises a first static clamping unit 61'. The first static clamping unit 61' is arranged co-linear and in tandem with the first cylinder housing 21'. The first static clamping unit 61' comprises a first sleeve 63', within which is arranged a first interior space 42' that is arranged in fluid communication with the fluid supply 31. The first interior space 42' of the first static clamping unit 61' is provided expandable by that a first flexible wall 48' of the first static clamping unit 61', upon pressurizing, will expand radially inward and come into clamping contact with the first envelope surface 13 of the second telescopic element 9". The second fluid actuator assembly 5 is fixed to a second interior portion 7" (inner wall) of the second telescopic element 9" and is arranged at the outermost end 11 of the second telescopic element 9". The second fluid actuator assembly 5 is provided for engagement or disengagement to the second envelope surface 15 of the third telescopic element 9". The second fluid actuator assembly 5 comprises a second cylinder housing 21" having a second piston 23" slidable mounted therein. The second piston 23" divides the interior of the second cylinder 21" housing into a first cylinder chamber 26' having a first fluid port 28' and a second cylinder chamber 26" having a second fluid port 28". The respective first 28' and second 28" fluid port is coupled to the fluid supply 31 via the valve device 33 for controlling the movement of the second piston 23". The second piston 23" comprises a second channel system 35" having a first cylinder chamber entrance 38' and a second cylinder chamber entrance 38" and a hollow space entrance 38". The hollow space entrance 38" is open to a second hollow space 41" of the second piston 23" arranged in the second piston 23" near a second contact surface 43" of the second piston 23" contacting the second envelope surface 15 of the third telescopic element 9". The second hollow space 41" is provided in a sealed manner so that no fluid is permitted to leak to the second contact surface 43". The second hollow space 41" is formed of a first and second wall section surface corresponding with the design of the first hollow space 41'. The first wall section of the second hollow space 41" and the second contact surface 43" are opposite each other and form a second flexible homogeneous wall portion 47" of the second piston 23", which second flexible homogeneous wall portion 47" is provided to the second piston 23" as an integral portion. The second hollow space 41" is provided to be expandable by that the second flexible homogeneous wall portion 47" is flexible. The second hollow space 41" is provided for fluid communication with the first 26' and the second cylinder chamber 26" via the second channel system 35" so as to provide a clamping action of the second flexible homogeneous wall portion 47" to the second envelope surface 15 of the third telescopic element 9". The second fluid actuator assembly 5 further comprises a second static clamping unit 61". The second static clamping unit 61" is arranged co-linear and in tandem with the second cylinder housing 21". The second static clamping unit 61" comprises a second sleeve 63", within which is arranged a second interior space 42" that is arranged in fluid communication with the fluid supply 31. The second interior space 42" of the second static clamping unit 61" is provided expandable by that a second flexible wall 48" of the second static clamping unit 61", upon pressurizing, will expand and come into clamping contact with the second envelope surface 15 of the third telescopic element 9". Such FIG. 1*b* illustrates a pressure enforcing device 400 of a first piston device 23' comprising a first piston rod engagement and disengagement device E'. The piston rod engagement and disengagement device E comprises the pressure strengthening device 400, which is provided to strengthening the engagement of the first piston device 23' to the adjacent telescopic element outer envelope surface (not shown). The pressure strengthening device 400 is provided for strengthening the engagement of the first piston device 23' to said adjacent enclosed telescopic element. The pressure strengthening device 400 is arranged within the first piston device 23' and is shown in an enlarged view. The pressure strengthening device 400 comprises a movable micro piston rod 401 having a first micro pressure area mpa1 and a second micro pressure area mpa2. The first micro pressure area mpa1 being larger than the second micro pressure area mpa2, and is in fluid communication with the pressurized fluid of the pressurized cylinder chamber (e.g. reference 25' in FIG. 1*a*). The second micro pressure area mpa2 is arranged in communication with a pressure strengthening fluid provided in a cavity 402 for acting upon a membrane means 403 of the first piston device 23'. Such pressure enforcing device 400 can be arranged also to the second piston device 23" comprising a second piston rod engagement and disengagement device E" (not shown).

Figure 2:
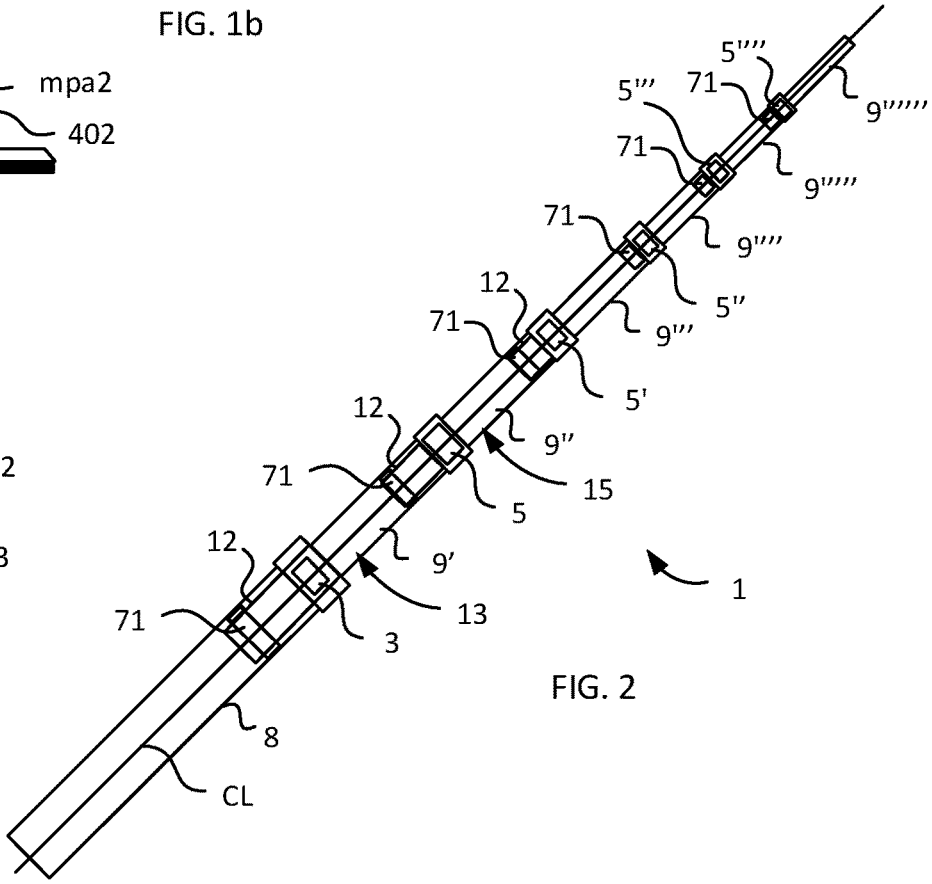
FIG. 2 illustrates a second example of a telescopic device in an extended state.

FIG. 2 illustrates a second example of an elongated telescopic device 1 in an extended state. The elongated telescopic device 1 comprises a hollow support element 8 formed to encompass nestled first 9', second 9", third 9''', fourth 9'''', fifth 9''''' and sixth 9'''''' telescopic elements (tubes) mounted so as to be telescopically slidable relative each other in a longitudinal direction along the centre line CL. The hollow support element 8 and the telescopic elements 9'-9''''' each comprises a fluid actuator assembly 3, 5, 5', 5", 5''', 5'''' arranged at the outermost end 11 of the respective telescopic element 9'-9'''''. The opposite ends 12 of the elements 9'-9''''' are provided with bearing members 71 fixedly mounted to interior portions of the telescopic elements 9'-9'''''. The respective bearing member 71 is thus arranged between two adjacent telescopic elements (for example between the telescopic element 9' and the telescopic element 9") and may comprise bronze alloy and/or tin bronze and/or lead free bronze and/or copper and/or aluminium-bronze and/or carbon graphite.

Figure 3A:
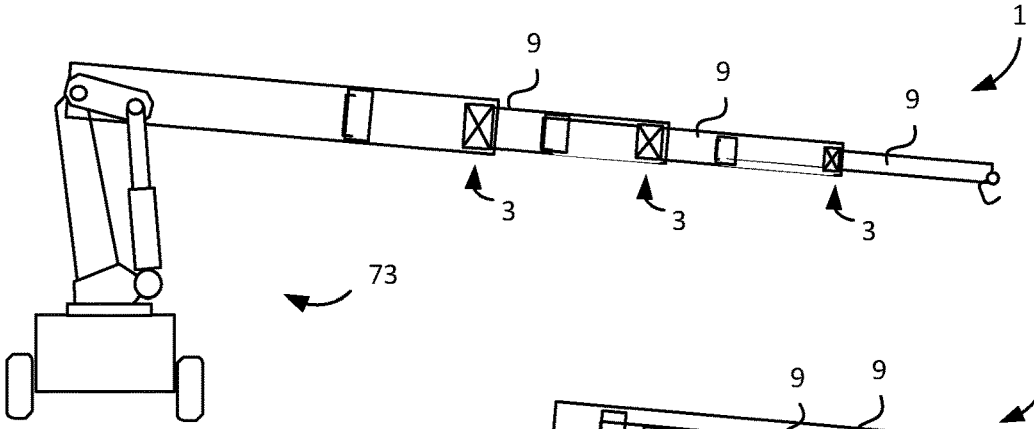
FIGS. 3*a* and 3*b* illustrate a third example of a telescopic device of a mobile crane.
Figure 3B:
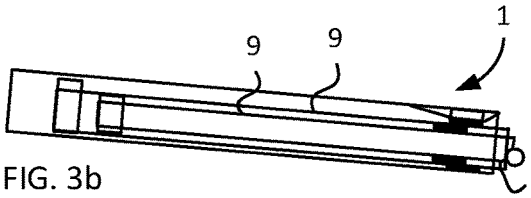

FIGS. 3*a* and 3*b* illustrate a third example of a telescopic device 1 of a mobile crane 73. The telescopic device 1 comprises a plurality of telescoping elements 9 mounted so as to be telescopically slidable relative each other and each telescoping element 9 comprises a fluid actuator assembly 3 arranged for clamping to an adjacent and encompassed (nestled) telescoping element 9. In FIG. 3*a* is shown a state presenting almost extended telescopic elements 9. The telescopic device 1 has been lowered to a negative slope so as to make use of kinetic energy and also potential energy to extend the nestled telescopic elements 9. In FIG. 3*b* is shown a state where the telescoping elements 9 have made a retraction motion by means of the fluid actuator assemblies 3.

Figure 4A:
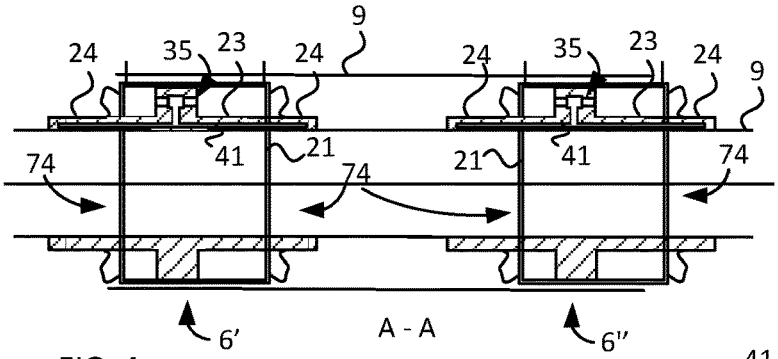
FIGS. 4*a* and 4*b* illustrate a fluid actuator assembly of a fourth example of a telescopic device.
Figure 4B:
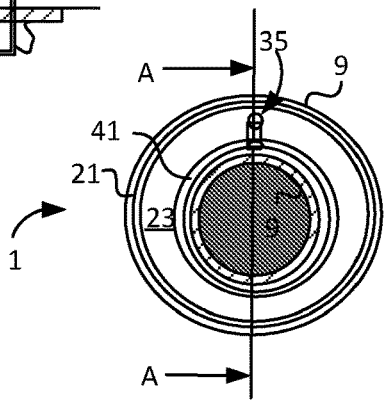

FIGS. 4*a* and 4*b* illustrate a fluid actuator assembly 3 of a fourth example of a telescopic device 1. The fluid actuator assembly 3 comprises two co-operating actuators 6', 6". In the FIG. 4*a* is shown that the respective piston 23 of each cylinder 21 comprises annular extensions 24 (extending in the axial direction) that protrude through bores 74 of cylinder cap ends 26 of the respective cylinder 21 and surround an adjacent telescopic element 9 to be propelled. Boots 75 are arranged at both cap ends 26 for collecting fluid that leaks between the cylinder bores 74 and the envelope surface 76 of the respective annular extension 24 of the piston 23. The collected fluid is re-used and fed to the fluid supply (not shown). The leakage between the cylinder bores 74 and the envelope surfaces 76 is predetermined so as to decrease the friction between the piston 24 and the cylinder 21. The telescopic elements 9 exhibit circular cross-sections as is shown in FIG. 4*b*.

Figure 5:
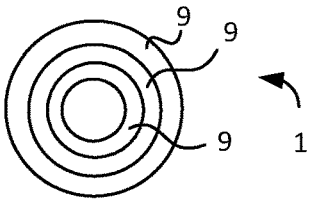
FIG. 5 illustrates a fifth example of a telescopic device in a front view.

FIG. 5 illustrates a fifth example of a telescopic device 1 in a front view. The telescopic device 1 comprises four telescopic elements 9 having circular cross-section.

Figure 6A:
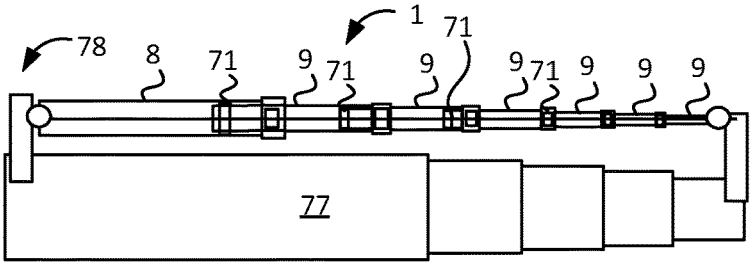
FIGS. 6*a* and 6*b* illustrate a sixth example of a telescopic device.
Figure 6B:
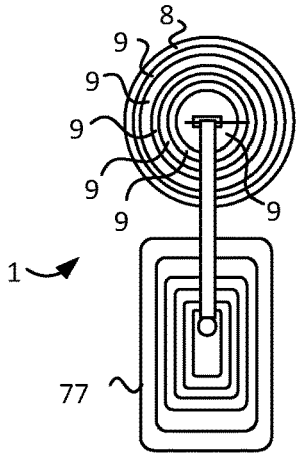

FIGS. 6*a* and 6*b* illustrate a sixth example of an elongated telescopic device 1. A telescopic arm 77 comprises five telescopic sections having rectangular cross-section as shown in FIG. 6*b*. The elongated telescopic device 1 comprises one support element 8 and six telescopic elements 9, as being shown in FIG. 6*a*. A respective fluid actuator assembly 3 is arranged at the respective outermost end of the telescopic elements 9. The opposite ends of the telescopic elements 9 are provided with bearing members 71. The elongated telescopic device 1 is mounted to one end of the telescopic arm 77 and to a base fundament 78 of the telescopic arm 77 for extension and retraction of the telescopic arm 77.

Figure 7:
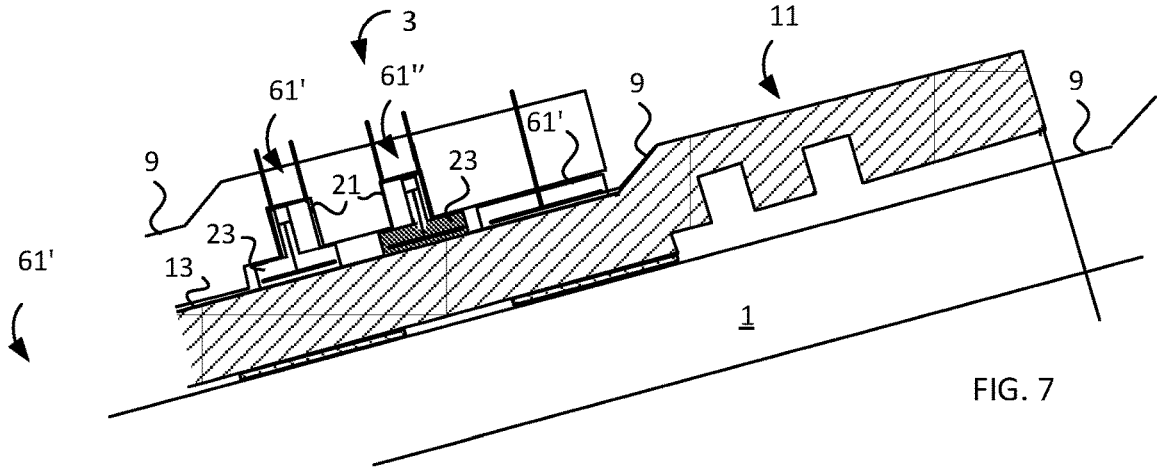
FIG. 7 illustrates a section of a seventh example of a telescopic device.

FIG. 7 illustrates a section of a seventh example of a section of a telescopic element 9 of telescopic device 1. The cross-section is taken along a centre line CL of the telescopic device 1 showing only ½ of the cross-section. In this example the fluid actuator assembly 3 comprises a first 62' and a second 62" hydraulic propulsion unit, each comprising a piston 23 arranged in a respective cylinder housing 21 and one hydraulic brake unit 61. The outermost end 11 of the telescopic element 9 is of somewhat greater diameter than the average diameter of the same telescopic element for encompassing the fluid actuator assembly 3. The first and second hydraulic propulsion units 62', 62" are composed of similar components as those being shown in FIG. 4*a*. The first and second hydraulic propulsion units 62', 62" co-operate for smooth for propulsion motion of the adjacent and encompassed (nestled) telescopic element 9 and each hydraulic propulsion unit 62', 62" alternately clamps on the envelope surface 13 of the adjacent and encompassed (nestled) telescopic element.

Figure 8:
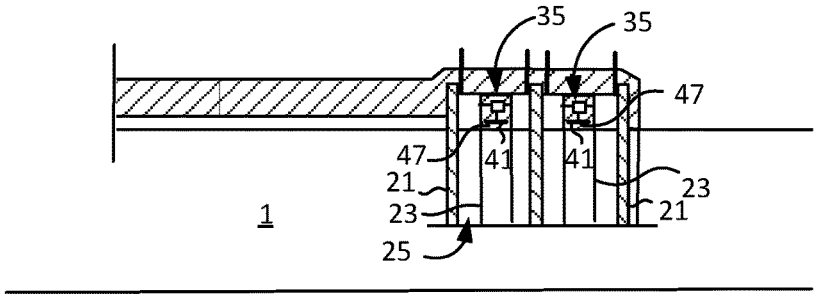
FIG. 8 illustrates a cross-section of an eight example of a telescopic device.

FIG. 8 illustrates a cross-section of an eight example of a telescopic device 1. The cross-section is taken along a centre line CL of the telescopic device 1 showing only ½ of the cross-section. In this example, the piston 23 of the respective cylinder housing 21 is encompassed entirely in the cylinder housing 23 and is slidable arranged therein. A channel system 35 is provided in respective piston 23 for offering fluid communication between the respective cylinder chamber 25 and a hollow space 41 forming a flexible inner clamping wall 47 of the piston 23.

Figure 9:
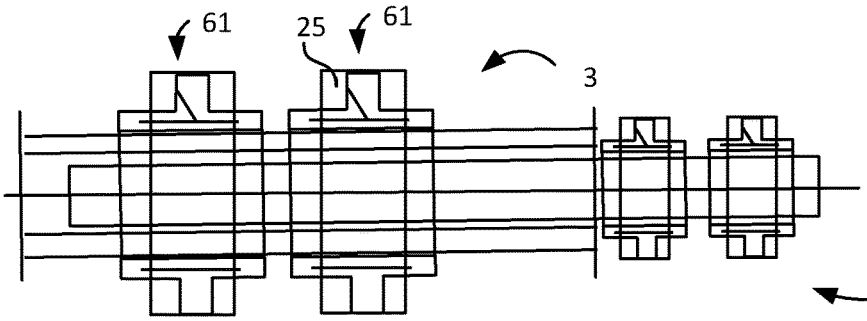
FIG. 9 illustrates a fluid actuator assembly of a ninth example of a telescopic device.

FIG. 9 illustrates a fluid actuator assembly 3 of a ninth example of a telescopic device 1. In this example the fluid actuator assembly 3 solely consists of two co-operating fluid actuators 61 provided for clamping action and for engagement or disengagement to an envelope surface 13 of a telescopic element 9 by pressurizing a rear cylinder chamber 25. The retraction of the telescopic elements 9 may be accomplished by a wire (not shown) coupled to an outer end (not shown) of the telescopic device 1 and to a winch (not shown).

Figure 10:
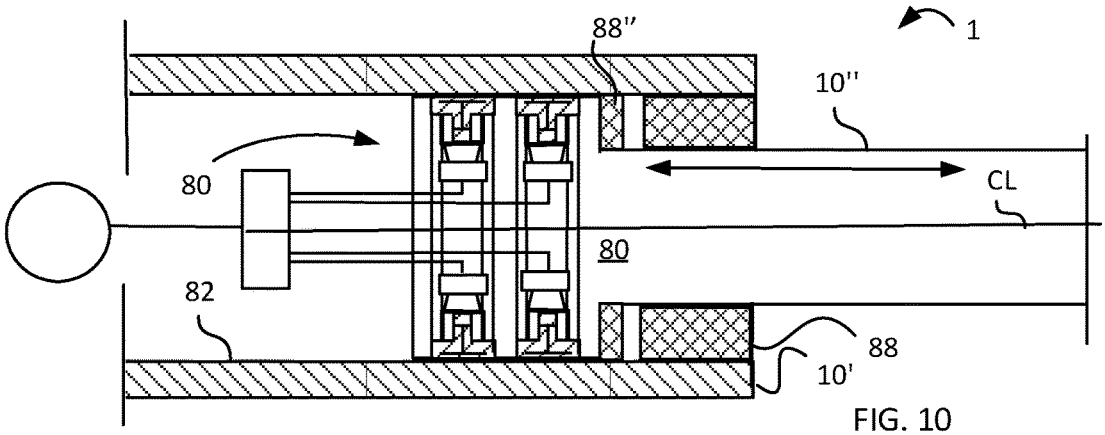
FIG. 10 illustrates a cross-section of a tenth example of a telescopic device.

FIG. 10 illustrates a cross-section of a tenth example of a telescopic device 1. The telescopic device 1 comprises a plurality of telescopic elements 10', 10" (two of which are shown). The first telescopic element 10' is formed to encompass the adjacent second telescopic element 10". All telescopic elements are arranged to be telescopically slidable relative each other in a longitudinal direction (corresponding with the centre line CL). The first telescopic element 10' comprises a first fluid actuator assembly (not shown). The second telescopic element 10" is arranged slidable within the first telescopic element 10' and comprises a fluid actuator assembly 80. The fluid actuator assembly 80 is fixed to an interior portion and at the innermost end 81 of the second telescopic element 10" and is arranged for engagement or disengagement to an interior surface 82 of the first telescopic element 10'. A third fluid actuator assembly (not shown) is fixed to an outer portion of a third telescopic element and is arranged for engagement or disengagement to a second interior surface (not shown) of the second telescopic element 10". A bearing member 88 is arranged between two adjacent telescoping elements 10', 10". A bearing device 88" is also arranged adjacent the fluid actuator assembly 80.

Figure 11:
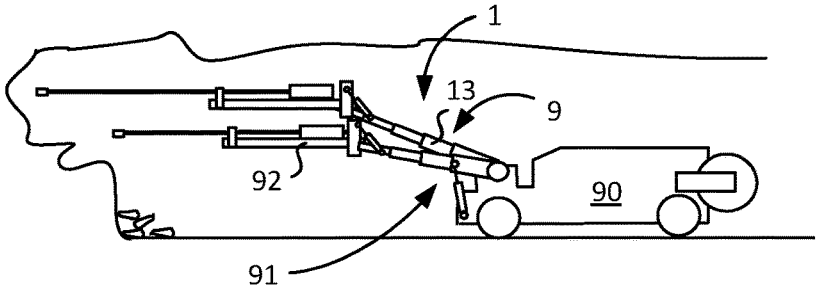
FIG. 11 illustrates an eleventh example of a telescopic device of a drilling apparatus vehicle.

FIG. 11 illustrates an eleventh example of a telescopic device 1 of a drilling apparatus vehicle 90. Rock drilling apparatus vehicles comprise boom arrangements 91 carrying drilling equipment 92. As mining equipment preferably being compact, the two telescopic devices 1 have been put into use in the drilling apparatus vehicle 90. The telescopic devices 1 serve as arms for a versatile and robust solution. The telescopic devices 1 provide that a wide range of drill/bolt lengths can be used and also enable that drilling equipment 92 of the boom arrangement 91 can be set up easily, accurately and with maximum stability and provide powerful rock drilling as each fluid actuator assembly (not shown) of respective telescopic element 9 also comprises a hydraulic static clamping unit similar to that shown in FIG. 1 in addition to a set of fluid actuator propulsion units (not shown) similar to these shown in FIG. 4*a*. The hydraulic static clamping unit comprises a clamping sleeve including a hollow space that is arranged to be pressurized by a fluid pressure fed by a fluid supply (not shown) of the vehicle 90 so as to expand an inner clamping wall (not shown) partly forming and sealingly limiting the hollow space for clamping on the envelope surface 13 of an adjacent telescopic element 9. Each fluid actuator propulsion unit comprises a piston including a hollow space forming a clamping membrane, which hollow space is pressurized by the fluid supply of the vehicle via a respective cylinder chamber (of a cylinder housing encompassing the piston) pressurized for propulsion of the adjacent telescopic element by means of the piston. The fluid actuator propulsion units are arranged and coupled to the fluid supply via a valve device (not shown) for operating the fluid actuator propulsion units for alternately propulsion and clamping of the adjacent encompassed (nestled) telescopic device 9.

Figure 12A:
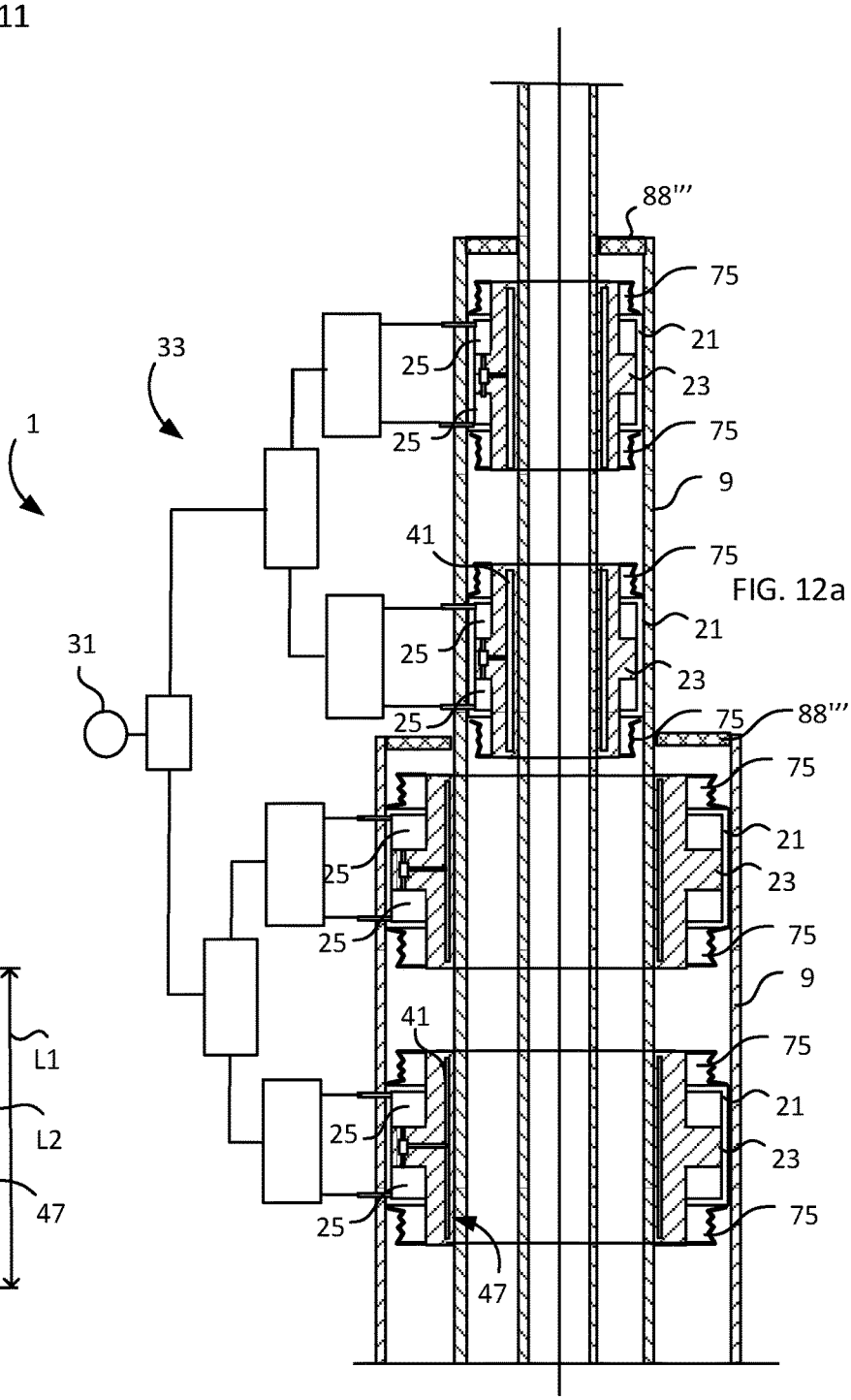
FIGS. 12*a* to 12*b* illustrate a portion of a twelfth example of a telescopic device.
Figure 12B:
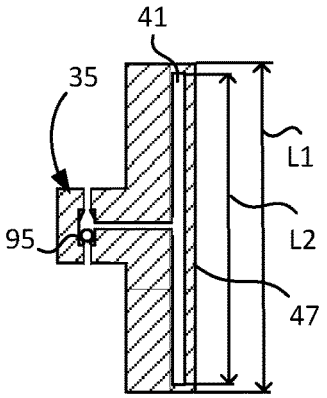

FIGS. 12*a* to 12*b* illustrate a portion of a twelfth example of a telescopic device 1. FIG. 12*a* shows a telescopic device 1 coupled to a fluid supply 31. Pilot and control valve devices 33 are arranged for controlling the fluid flow to the respective cylinder chamber 25. A respective piston 23 comprises a hollow space 41 for clamping action. The hollow space 41 is pressurized for clamping action and a flexible annular wall 47 portion of the piston 23 expands toward the envelope surface of the encompassed and adjacent telescopic element 9. A boot member 75 is provided at each end of the cylinder 21 for collecting fluid that leak from the cylinder chamber between the piston extension and a bore of the cylinder 21 through which the piston 23 extension protrudes. Each pair of fluid actuator assembly mounted to a separate telescopic element 9 being controlled to operate with alternately clamping for propulsion of the encompassed telescopic element. The pressurization of the hollow space 41 (and thus the clamping action) is performed by that the fluid is fed to the cylinder 21 and the respective cylinder chamber 25 for achieving a motion of the piston 23 relative the cylinder 21. A shuttle valve 95 is arranged to a channel system 35 of the piston 23 for directing the fluid flow to the hollow space 41 from the respective cylinder chamber 25. A bearing member 88'" is provided at the outermost end of the respective telescopic element 9. Preferably, the proportion between the measure of inner and outer circumference of the piston body envelope surface (inner circumference/outer circumference) is larger than 0.5. FIG. 12*b* illustrates that the length L1 of the piston 23 sliding surface, being in slidable contact with a portion of the envelope surface (in disengaged state), is slightly less in measure than the length L2 of the hollow space 41 as seen in the longitudinal direction.

Figure 13A:
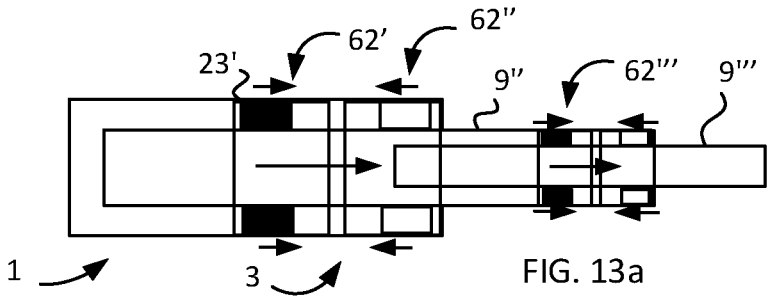
FIGS. 13*a* to 13*d* illustrate a thirteenth example of a telescopic device and extension operation.
Figure 13B:
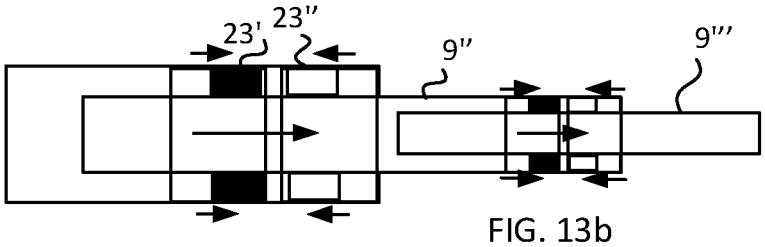
Figure 13C:
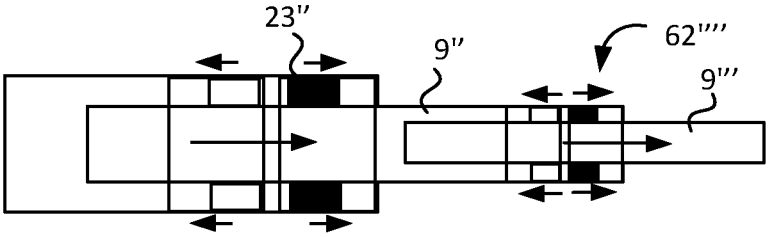
Figure 13D:
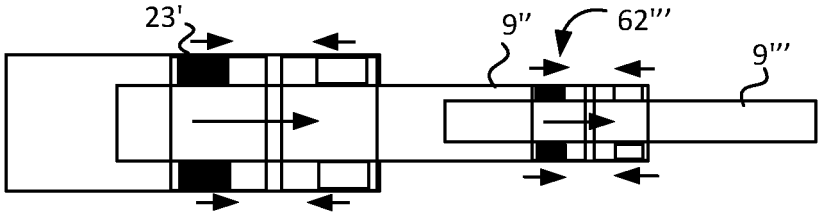

FIGS. 13*a* to 13*d* illustrate a thirteenth example of a telescopic device 1 and extension operation. In this example only being shown two pairs of fluid actuator assemblies 3 mounted to respective telescopic element 9', 9". Each fluid actuator unit 62 being controlled by control valve members (not shown) to alternately provide a clamping action for propulsion of the encompassed telescopic element 9', 9". A first fluid actuator unit 62' in FIG. 13*a* clamps (is engaged) around the second telescopic element 9" and a second fluid actuator unit 62" is disengaged. The first piston 23' of the first fluid actuator unit 62' propels the second telescopic element 9" a first distance at the same time as a third fluid actuator unit 62'" clamps and propels a third telescopic element 9'" a third distance. In FIG. 13*b* is shown that the first piston 23' has reached its end position and the second piston 23" has been retracted to a start position. In FIG. 13*c* is shown that the second piston 23" is engaged with the second telescopic element 9" and propels it a second distance. At the same time a fourth fluid actuator unit 62"" clamps and propels the third telescopic element 9'" a fourth distance. The operation proceeds repeatedly as shown in FIG. 13*d*, wherein the telescopic elements are extracted.

Figure 14:
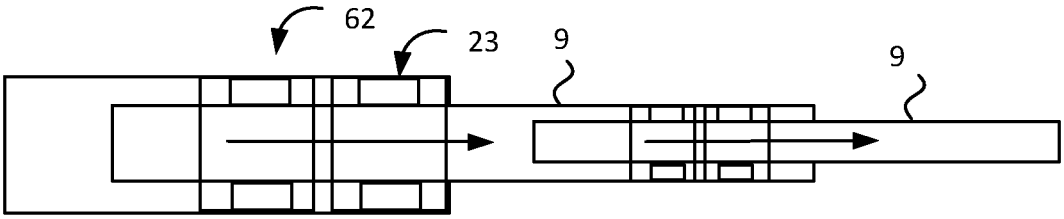
FIG. 14 illustrates a fourteenth example of a telescopic device using kinetic energy.

FIG. 14 illustrates a fourteenth example of a telescopic device 1 using kinetic energy. Each fluid actuator unit 62 being controlled by a control unit (not shown) controlling a control valve member (not shown) to fed pressurized fluid to the engagement and disengagement device E for alternately provide a clamping action for propulsion of the encompassed telescopic element 9 in a starting cycle.

For saving energy, all the fluid actuator units are disengaged from the respective telescopic element, wherein the kinetic energy provides further extraction motion of the telescopic elements 9. The same procedure may be used for retraction.

Figure 15A:
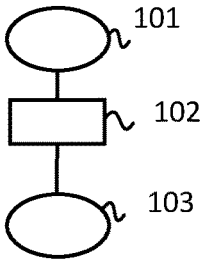
FIGS. 15*a* and 15*b* illustrate flowcharts showing alternative methods for operating a telescopic device.
Figure 15B:
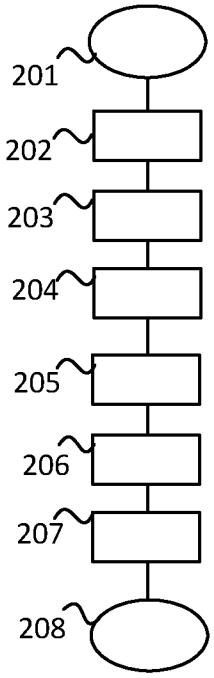

FIGS. 15*a* and 15*b* illustrate flowcharts showing alternative methods for operating a telescopic device. FIG. 15*a* shows a flowchart of a method according to one aspect of the invention. The method starts in a Step 101. In Step 102 there is provided a method for operating a telescopic device comprising a support element and a first and second telescopic element, wherein each of the support element and the first telescopic elements comprises a first and second engagement and disengagement device, the first and second engagement and disengagement device of the support element being arranged for releasable clamping action to the first telescopic element, the first and second engagement and disengagement device of the first telescopic element being arranged for releasable clamping action to the second telescopic element, the respective first and second engagement and disengagement device being coupled to a control valve unit and a fluid supply for providing a motion of the support element and the first and second telescopic elements relative each other in an longitudinal direction. In Step 103 the method is fulfilled and stopped. The step 102 comprises the steps of; pressurizing the first engagement and disengagement device with a first pressure for clamping action; pressurizing the second engagement and disengagement device with a second pressure for a release action and retraction of the second engagement and disengagement device to a start position; pressurizing the first engagement and disengagement device with a second pressure for release; pressurizing the second engagement and disengagement device with a first pressure for clamping action and propelling the second engagement and disengagement device so as to provide said motion in said longitudinal direction.

FIG. 15*b* shows a flowchart of a method according to one aspect for operating a telescopic device comprising a support element and a first and second telescopic element, wherein each of the support element and the first telescopic elements comprises a first and second engagement and disengagement device, the first and second engagement and disengagement device of the support element being arranged for releasable clamping action to the first telescopic element, the first and second engagement and disengagement device of the first telescopic element being arranged for releasable clamping action to the second telescopic element, the respective first and second engagement and disengagement device being coupled to a control valve unit and a fluid supply for providing a motion of the support element and the first and second telescopic elements relative each other in an longitudinal direction. The method starts in a Step 201. In Step 202 there is provided pressurizing of the first engagement and disengagement device with a first pressure for clamping action. In Step 203 there is provided pressurizing of the second engagement and disengagement device with a second pressure for a release action and retraction of the second engagement and disengagement device to a start position. In step 204 there is provided pressurizing the first engagement and disengagement device with a second pressure for release. In step 205 there is provided pressurizing of the second engagement and disengagement device with a first pressure for clamping action and propelling the second engagement and disengagement device so as to provide said motion in said longitudinal direction. In step 206 there is provided pressurizing of the first and second engagement and disengagement device of the respective support element and the first telescopic element with a second pressure for release action of the first and second engagement and disengagement devices from the respective support element and the first telescopic element, so as to extend the telescopic device by means of kinetic energy. As an alternative step 207, there is provided lowering of the telescopic device to a negative slope so as to make use of potential energy to extend the encompassed (nestled) first and second telescopic element. In Step 208 the method is fulfilled and stopped.

The elongated telescopic device comprising the telescopic elements and fluid actuator assemblies may according to different aspects be adapted to one or several of following industrial segments; construction industry, jacking systems for oil well drilling and service platforms, agricultural equipment industry, marine industry, crane manufacture industry and other industrial segments.

The present invention is of course not in any way restricted to the preferred embodiments described above, but many possibilities to modifications, or combinations of the described embodiments, thereof should be apparent to a person with ordinary skill in the art without departing from the basic idea of the invention as defined in the appended claims.

One aspect may involve that the telescopic device is adapted for momentary disengaging all pistons from the encompassed adjacent encompassed (nestled) telescopic element for propelling the mass of the telescopic elements using the kinetic energy of the mass (in a way reminding of a freewheel clutch). One aspect may involve that a static clamping unit may clamp (hold) rigidly to the entire circumference of the envelope surface of the telescopic element being in contact with the inner surface (clamping surface) of the static clamping unit. One aspect may involve that a clamping surface of a piston of a fluid actuator exhibits larger area than that of a piston force area of the piston. The clamping surface of the static clamping unit, seen in the axial direction, has an extension that is longer than the length of a clamping surface of a piston of a fluid actuator, seen in the axial direction. The fluid may be gas or hydraulic oil.

The invention claimed is:

1. An elongated telescopic device comprising a support element formed to partly or entirely encompass first and second telescopic elements mounted so as to be telescopically slidable relative to each other in a longitudinal direction;

the support element comprises a support element fluid actuator assembly;

the first telescopic element is arranged to encompass the second telescopic element and comprises a first fluid actuator assembly; characterized in that the support element fluid actuator assembly is fixed to an interior portion of the support element and is arranged for engagement or disengagement to a first envelope surface of the first telescopic element;

the first fluid actuator assembly is fixed to a first interior portion of the first telescopic element and is arranged for engagement or disengagement to a second envelope surface of the second telescopic element, wherein a first and second piston body of the first fluid actuator assembly acts alternately for propelling an adjacent telescopic element, wherein the respective first and second piston body in turn is engaged with the adjacent telescopic element, wherein a first engagement and disengagement device of the first piston body comprises a first expandable hollow space and a first expandable clamping wall; and wherein the first expandable clamping wall expands in radial direction toward the envelope surface of the adjacent positioned telescopic element and clamps around the envelope surface.

2. The elongated telescopic device according to claim 1, wherein a second fluid actuator assembly is fixed to a second interior portion of the second telescoping element and is arranged for engagement or disengagement to a third envelope surface of a third telescoping element.

3. The elongated telescopic device according to claim 1, wherein the elongated telescopic device comprises a plurality of further telescoping elements mounted so as to be telescopically slidable relative to each other, each further telescoping element comprises a fluid actuator assembly arranged for engagement with an adjacent telescoping element.

4. The elongated telescopic device according to claim 1, wherein a bearing member is arranged between two adjacent telescoping elements, which bearing member comprises bronze alloy and/or tin bronze and/or lead free bronze and/or copper and/or aluminium-bronze and/or carbon graphite.

5. The elongated telescopic device according to claim 1, wherein the telescoping element exhibits a circular cross-section.

6. The elongated telescopic device according to claim 1, wherein at least one of the first fluid actuator assembly or the support element comprises a first cylinder chamber and a first piston body having a first expandable hollow space provided for fluid communication with the first cylinder chamber so as to provide engagement with an envelope surface of an inside positioned telescopic element.

7. The elongated telescopic device according to claim 6, wherein the fluid actuator assembly further comprises a second cylinder chamber, at least one of the first and second cylinder chamber is coupled to a fluid supply via a valve device.

8. The elongated telescopic device according to claim 1, wherein the second piston body of the first fluid actuator assembly comprises a static clamping unit or at least one fluid actuator unit.

9. A mobile drilling apparatus vehicle comprising an elongated telescopic device according to claim 1, wherein the elongated telescopic device is arranged as an arm member of the mobile drilling apparatus vehicle, which arm member carries a drilling and/or bolting equipment.

10. A mobile crane comprising an elongated telescopic device according to claim 1, wherein the telescopic elements constitute crane boom sections or are arranged either inside or outside the crane boom sections.

11. A method for operating a telescopic device comprising a support element and a first and second telescopic element;

each of the support element and the first telescopic element comprises a first and second engagement and disengagement device;

the first and second engagement and disengagement device of the support element being arranged for releasable clamping action to the first telescopic element;

the first and second engagement and disengagement device of the first telescopic element being arranged for releasable clamping action to the second telescopic element;

the respective first and second engagement and disengagement device being coupled to a control valve unit and a fluid supply for providing a motion of the support element and the first and second telescopic elements relative to each other in an longitudinal direction; the method comprises the steps of:

pressurizing the first engagement and disengagement device with a first pressure for clamping action;

pressurizing the second engagement and disengagement device with a second pressure for a release action and retraction of the second engagement and disengagement device to a start position;

pressurizing the first engagement and disengagement device with a second pressure for release;

pressurizing the second engagement and disengagement device with a first pressure for clamping action and propelling the second engagement and disengagement device so as to provide said motion in said longitudinal direction.

* * * * *